US007076950B2

(12) United States Patent
Klostermann

(10) Patent No.: US 7,076,950 B2
(45) Date of Patent: Jul. 18, 2006

(54) INTERNAL EXPLOSION ENGINE AND GENERATOR USING NON-COMBUSTIBLE GASES

(75) Inventor: Heinrich Franz Klostermann, San Mateo, CA (US)

(73) Assignee: Clean Energy, Inc., Palo Alto, CA (US)

( * ) Notice: Subject to any disclaimer, the term of this patent is extended or adjusted under 35 U.S.C. 154(b) by 0 days.

(21) Appl. No.: 10/823,966

(22) Filed: Apr. 13, 2004

(65) Prior Publication Data

US 2004/0200216 A1 Oct. 14, 2004

Related U.S. Application Data

(60) Provisional application No. 60/462,993, filed on Apr. 14, 2003.

(51) Int. Cl.
*F01B 29/00* (2006.01)

(52) U.S. Cl. ..... 60/513; 60/512; 60/515

(58) Field of Classification Search ..... 60/517, 60/512, 513, 515
See application file for complete search history.

(56) References Cited

U.S. PATENT DOCUMENTS

| | | | | |
|---|---|---|---|---|
| 2,984,067 | A * | 5/1961 | Morris | 60/513 |
| 3,237,847 | A * | 3/1966 | Wilson | 417/53 |
| 3,670,494 | A | 6/1972 | Papp | |
| 3,680,431 | A | 8/1972 | Papp | |
| 4,306,414 | A * | 12/1981 | Kuhns | 60/510 |
| 4,416,113 | A * | 11/1983 | Portillo | 60/513 |
| 4,428,193 | A | 1/1984 | Papp | |
| 5,899,071 | A * | 5/1999 | Stone et al. | 60/641.8 |
| 6,272,855 | B1 * | 8/2001 | Leonardi | 60/513 |
| 6,739,131 | B1 * | 5/2004 | Kershaw | 60/512 |

OTHER PUBLICATIONS

Mallove et al., Infinite Energy, Sep./Oct. 2003, vol. 9, No. 51, New Energy Foundation, Inc., Concord, NH, USA.

* cited by examiner

*Primary Examiner*—Hoang Nguyen

(57) ABSTRACT

Internal explosion engine and generator having an explosion chamber, a movable member forming one wall of the chamber, a charge of non-combustible gas sealed inside the chamber, means for repeatedly igniting the gas in an explosive manner to drive the movable member from a position of minimum volume to a position of maximum volume, means for returning the movable member from the position of maximum volume to the position of minimum volume, and means coupled to the movable member for providing electrical energy in response to explosion of the gas. In one disclosed embodiment, the movable member is a piston connected to a crankshaft, and it is returned to the position of minimum volume by a flywheel on the crankshaft. In another, two pistons are connected back-to-back in a hermetically sealed chamber to prevent loss of the explosive gas. In one embodiment, the electrical energy is produced by a generator connected to the crankshaft, and in the other it is produced by a coil positioned near a magnet which moves with the pistons.

21 Claims, 4 Drawing Sheets

INTERNAL EXPLOSION ENGINE AND GENERATOR USING NON-COMBUSTIBLE GASES

RELATED APPLICATION

This application is based upon Provisional Application No. 60/462,993, filed Apr. 14, 2003, the priority of which is claimed.

BACKGROUND OF THE INVENTION

1. Field of Invention

This invention pertains generally to engines and generators and, more particularly, to an internal explosion engine and generator using non-combustible gases.

2. Related Art

An internal explosion engine is generally similar in principle to an internal combustion engine except that it uses non-combustible gases such as air, oxygen, nitrogen or inert gas(es) instead of the combustible gases which are used in internal combustion engines.

Prior to operation, the gas for operating an internal explosion engine is placed in the explosion chamber of the engine, and the chamber is sealed. During operation, the gas in the explosion chamber is repeatedly compressed, ionized, explosively expanded and contracted to move a piston or rotor or other movable device to convert kinetic energy to mechanical or electrical energy.

Once the gas has been loaded into the explosion chamber, the engine can operate for extended periods of time without additional fuel. There is no need for fuel intake on each cycle of operation, as in an internal combustion engine, and there is no exhaust.

Examples of internal explosion engines of the prior art are found in U.S. Pat. Nos. 3,670,494 and 4,428,193.

OBJECTS AND SUMMARY OF THE INVENTION

It is, in general, an object of the invention to provide a new and improved internal explosion engine and generator.

Another object of the invention is to provide an internal explosion engine and generator of above character which overcomes the limitations and disadvantages of the engines and generators heretofore provided.

These and other objects are achieved in accordance with the invention by providing an internal explosion engine and generator which has an explosion chamber, a movable member forming one wall of the chamber, a charge of non-explosive gas sealed inside the chamber, means for repeatedly igniting the gas in an explosive manner to drive the movable member from a position of minimum volume to a position of maximum volume, means for returning the movable member from the position of maximum volume to the position of minimum volume, and means coupled to the movable member for providing electrical energy in response to explosion of the gas.

In one disclosed embodiment, the movable member is a piston connected to a crankshaft, and it is returned to the position of minimum volume by a flywheel on the crankshaft. In another, two pistons are connected back-to-back in a hermetically sealed chamber to prevent loss of the explosive gas. In one embodiment, the electrical energy is produced by a generator connected to the crankshaft, and in the other it is produced by a coil positioned near a magnet which moves with the pistons.

DETAILED DESCRIPTION

Figure 1:
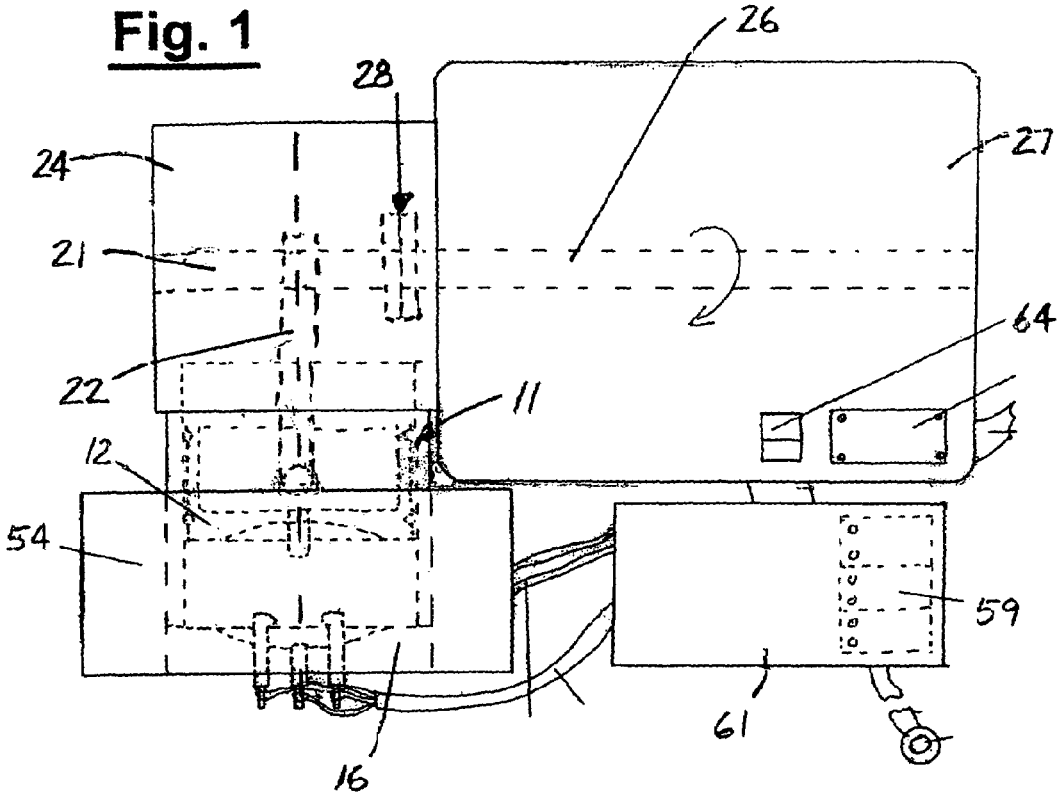
FIG. 1 is a top plan view of one embodiment of an internal explosion engine and generator incorporating the invention.
Figure 2:
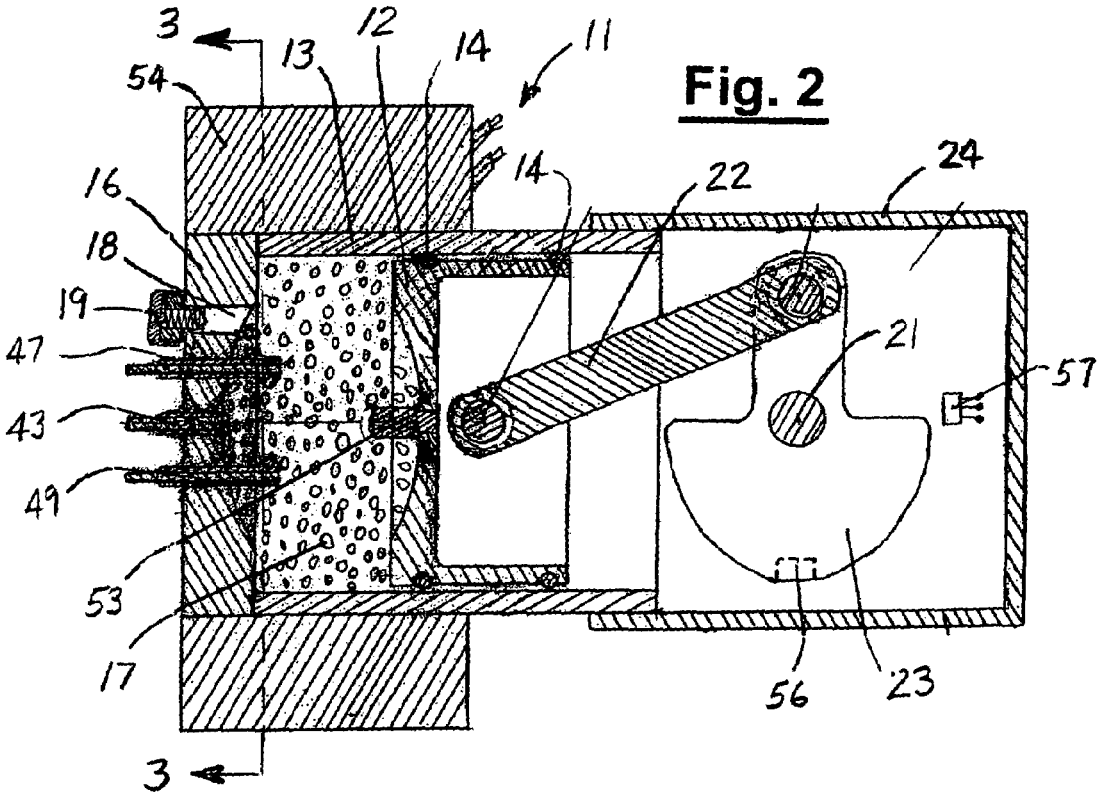
FIG. 2 is a cross-sectional view, taken along line 2—2 in FIG. 1.
Figure 3:
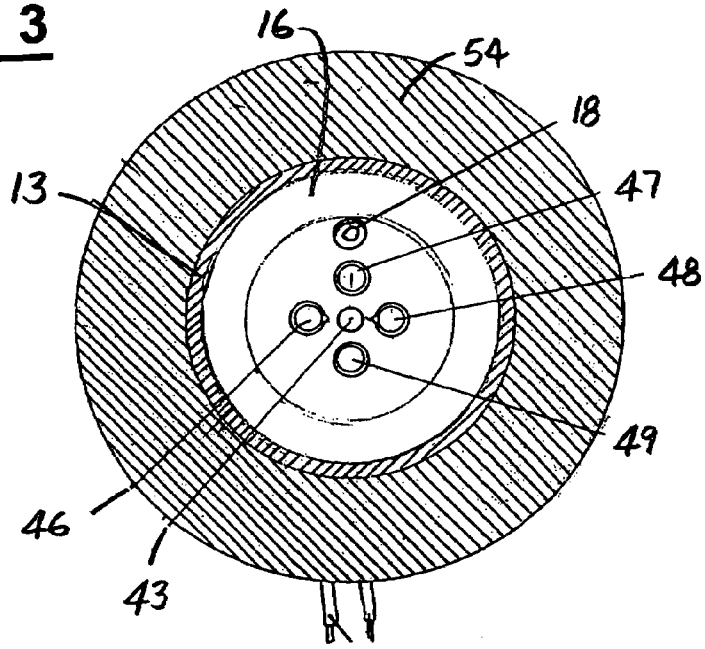
FIG. 3 is a cross-sectional view, taken along line 3—3 in FIG. 2.
Figure 4:
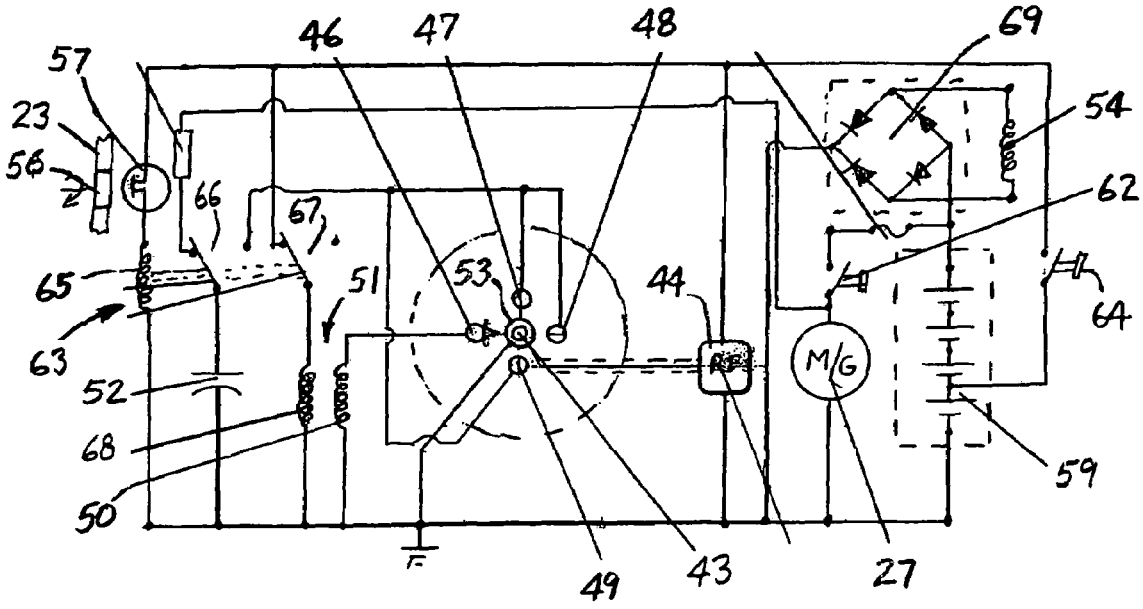
FIG. 4 is a circuit diagram of the embodiment of FIG. 1.

As illustrated in FIGS. 1–3, the engine 11 includes a piston 12 in a cylinder 13, with rings 14 providing a seal between the piston and the inner wall of the cylinder. The upper or outer end of the cylinder is sealed by an end plate or head 16, and an explosion chamber 17 is formed between the cylinder head and the piston.

An inlet port 18 is formed in the cylinder head for introducing a charge of gas into the explosion chamber, and the admission of gas through the port is controlled by a valve assembly 19.

The piston is connected to a crankshaft 21 by a connecting rod 22, and the crankshaft includes a counterweight or flywheel 23. In operation, the piston is driven in a downward direction by the explosion of the gas in the chamber and returned to the firing position by energy stored in the flywheel. The lower end of cylinder 13 is closed by a crankcase housing 24.

The crankshaft is connected to the shaft 26 of a generator 27 located outside the crankcase housing by a coupling 28. As discussed more fully hereinafter, the generator can also be driven as a motor for use in starting the engine.

In the embodiment illustrated, valve assembly 19 is a one-way check valve which allows gas to pass into but not out of the explosion chamber through inlet port 18. The valve assembly is shown in greater detail in FIG. 7, and includes a body or bushing 31 with an axial bore or passageway 32. The inner end of the valve body is threaded into the port, and a cap 33 is threaded onto the enlarged outer end of the body. The cap includes a passageway 34, with communication between that passageway and passageway 32 being controlled by a ball 36 which is received in a seat 37 on the inner side of the cap. The ball is urged toward a closed position against the seat by a spring 38 which is constrained between the ball and a shoulder 39 at the inner end of the valve body. A gasket 41 provides a seal between the outer portion of the body and the head.

Electrodes are mounted in the head for igniting the gas in the chamber. A high frequency electrode 43 is positioned axially of the chamber and connected to a radio frequency generator 44 for ionizing the gas to form a plasma. Electrodes 46–49 are spaced about electrode 43, with electrode 46 being connected to the secondary winding 50 of a spark coil 51 and electrodes 47–49 being connected to a capacitor 52. A contact pin 53 projects from the face of the piston in alignment with electrode 43.

Piston 12 and end plate or head 16 are fabricated of a ferro-magnetic material such as Grade 416 stainless steel, and cylinder 13 is fabricated of a non-ferrous material such Grade 303 stainless steel. A coil 54 is disposed about the outer portion of the cylinder and coupled magnetically with the piston to form a reluctance generator.

Means is provided for detecting when the piston is in its top dead center (TDC) or minimum volume position. This means includes a magnet 56 which is mounted on the counterweight or flywheel portion 23 of crankshaft 21 and a Hall switch 57 which is mounted in a stationary position in the crankcase and actuated by the magnet when it comes into proximity to the switch.

Power for operating generator 27 as a motor to start the engine is provided by batteries 59 which, in the embodiment illustrated, are mounted inside the housing of a controller 61 for the generator. The batteries are connected to the motor by a normally open starting switch 62.

The batteries also provide power for RF generator 44 and for the electrodes 46–49 which ignite the gas in the chamber, with energization of those electrodes being controlled by a relay 63. The application of power to the RF generator is controlled by an on/off switch 64, and energization of relay coil 65 is controlled by the on/off switch and by Hall switch 57 which is connected between the on/off switch and the relay coil.

The relay has a first set of contacts 66 which switch capacitor 52 between the power source and electrodes 47–49, and a second set of contacts 67 which connect the primary winding 68 of spark coil 51 to the power source.

The batteries are charged with the current produced in coil 54 by the reluctance generator. That coil is connected to the input of a power rectifier 69, and the output of the rectifier is connected to the batteries.

Prior to operation, a charge of air is introduced into explosion chamber through check valve 19 and inlet port 18. To start the engine, on/off switch 64 is closed, thereby energizing RF generator 44 and the primary winding of spark coil 51 and applying charging current to capacitor 52, and starter switch 62 is closed to energize generator 27 as a starting motor. The gas in the chamber is ionized by the RF power applied to electrode 43 to form a plasma.

As the piston makes its upward stroke, the air is compressed and heated, and toward top dead center, the air is ionized by the. RF power applied to electrode 43 to form a plasma. When the piston is at or near top dead center, Hall switch 57 closes, energizing relay coil 65. When the relay coil is energized, contacts 66 apply the charge which has built up on capacitor 52 to electrodes 47–49, and contacts 67 open to interrupt the current in the primary winding of spark coil 51, producing a high voltage discharge between spark electrode 46 and the contact pin 53 on the piston.

The spark from electrode 46 and the current from electrodes 47–49 flowing through the ionized air ignite the air, causing it to explode and produce a lightning-like pressure wave, with ultraviolet light, ozone and heat. That pressure wave drives the piston in a downward direction, turning crankshaft 21 and generator 27, storing mechanical energy in the flywheel and producing electrical energy from the generator.

After the piston reaches its maximum volume or bottom dead center (BDC) position the mechanical energy stored in the flywheel causes the crankshaft to continue rotating, thereby driving the piston back toward top dead center.

The same charge of air is ignited over and over again for an extended period of time, and to the extent that any of the air is lost past the piston rings, it is automatically replenished by air entering the chamber through the check valve. Thus, with the piston on its down stroke, if the pressure in the chamber drops below the level set by spring 38, ball 36 moves away from its seat, allowing air to enter the chamber through the inlet port. During the upstroke, the pressure in the chamber holds the bail tightly against the seat, sealing the air in the chamber.

Figure 5:
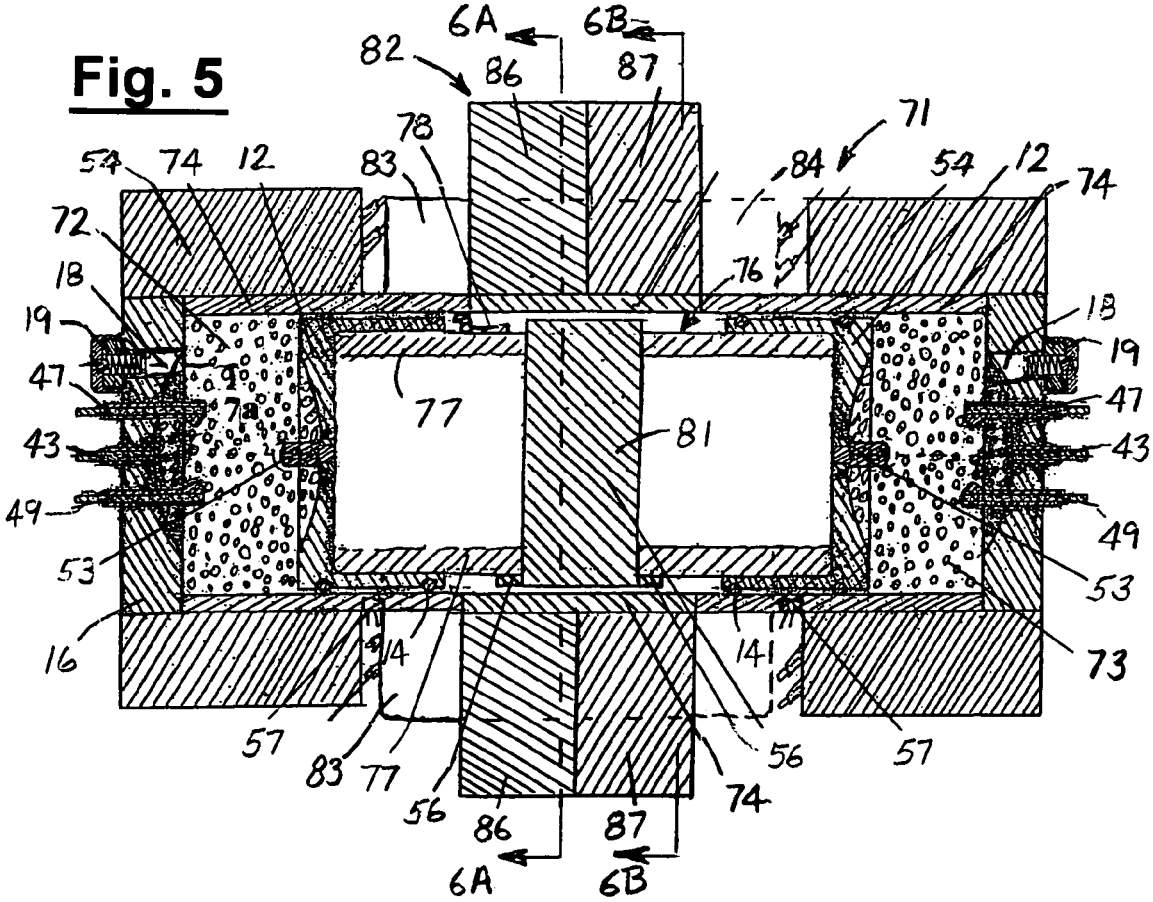
FIG. 5 is a centerline sectional view of another embodiment of an internal explosion engine and generator incorporating the invention.

The embodiment of FIG. 5 includes a free piston engine 71 which has a pair of explosion chambers 72, 73 at opposite ends of a cylinder 74. This engine differs from the embodiment of FIG. 1 in that it has no crankshaft. However, the power producing mechanism is the same, and like reference numerals designate corresponding elements in the two embodiments. The outer ends of the cylinder are closed by end plates or heads 16, and the volumes of the two chambers vary in an opposite or complementary manner as a double ended piston assembly 76 is driven back and forth within the cylinder.

The piston assembly includes a pair of pistons 12 which are connected together in back-to-back fashion by a sleeve 77, with rings 14 providing a seal between the pistons and the cylinder. The pistons have central contact pins 53, and each of the explosion chambers has an inlet port 18 and electrodes 43, 46–49 for ionizing and igniting the gas.

As in the embodiment of FIG. 1, piston 12 and end plates 16 are fabricated of a ferro-magnetic material, and cylinder 74 is fabricated of a non-ferrous material such as non-ferrous stainless steel or nickel plated aluminum. Sleeve 77 is fabricated of a non-ferrous material such as aluminum. Coils 54 are disposed about the outer portions of the cylinder and coupled magnetically with the pistons to form reluctance generators.

Sleeve 77 carries magnets 56 which actuate Hall switches 57 mounted outside cylinder 74 to determine when the pistons are at or near their top dead center (TDC) positions. A grounding contact 78 carried sleeve 77 makes sliding contact with the wall of the cylinder to maintain the pistons and contact pins 53 at ground potential.

The piston assembly also includes a relatively large permanent magnet 81 which is carried by sleeve 77 midway between the pistons. A ferro-magnetic core structure 82 provides flux coupling between magnet 81 and stator coils 83, 84 which are located outside the cylinder.

The core structure includes a pair of generally C-shaped cores 86, 87, each of which has pair of relatively short inner arms 86*a*, 87*a* which abut against the upper and lower surfaces of cylinder 74 and an outer arm 86*b*, 87*b* which is spaced laterally from the cylinder. The ends of the inner arms which abut against the cylinder have a concave curvature which matches the convex curvature of the outer wall of the cylinder, and coils 83, 84 are wound about outer arms of the cores. The cores are formed in two sections, with a split 88 across the outer arms to facilitate assembly.

Steel laminations 89 are embedded in the cylinder wall in contact with the short arms of the cores to complete the magnetic circuit. The laminations are hermetically sealed into the cylinder wall, and in one presently preferred embodiment they are stacks of silicon steel laminations with a thickness of 0.005 inch and a layer of nickel plating less than 0.001 inch thick sealing the stacks.

The stator coils can be utilized both as the windings of a motor for starting the engine and thereafter as the windings of a generator in which an electric current is produced as the piston assembly oscillates back and forth within the cylinder.

Since the cylinder is hermetically sealed, any gas leaking past the rings of the pistons will remain within the engine, rather than being lost to the outside environment as in the embodiment of FIG. 1.

In addition to air, suitable gases for use in the embodiment of FIG. 5 include inert gases, oxygen, and mixtures of such gases.

Figure 7:
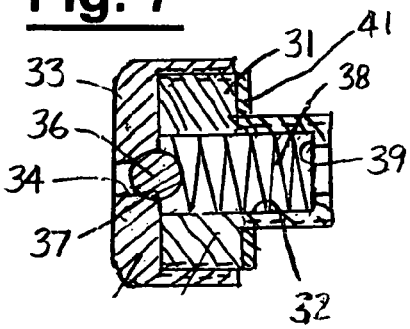
FIGS. 7 and 8 are enlarged centerline sectional views of valve and plug assemblies for the gas loading port in the embodiments of FIGS. 1 and 5.
Figure 8:
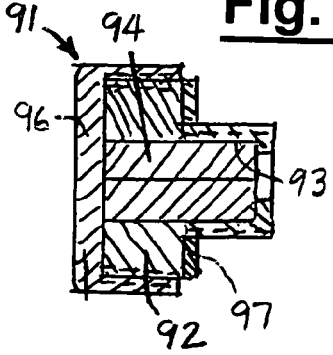
Figure 6A:
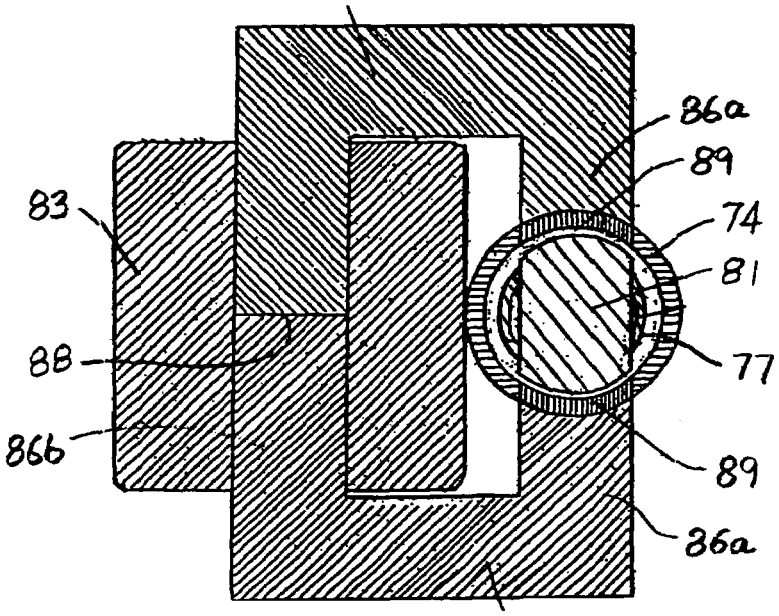
FIGS. 6A and 6B are cross-sectional views, taken along lines 6A—6A and 6B—6B in FIG. 5.
Figure 6B:
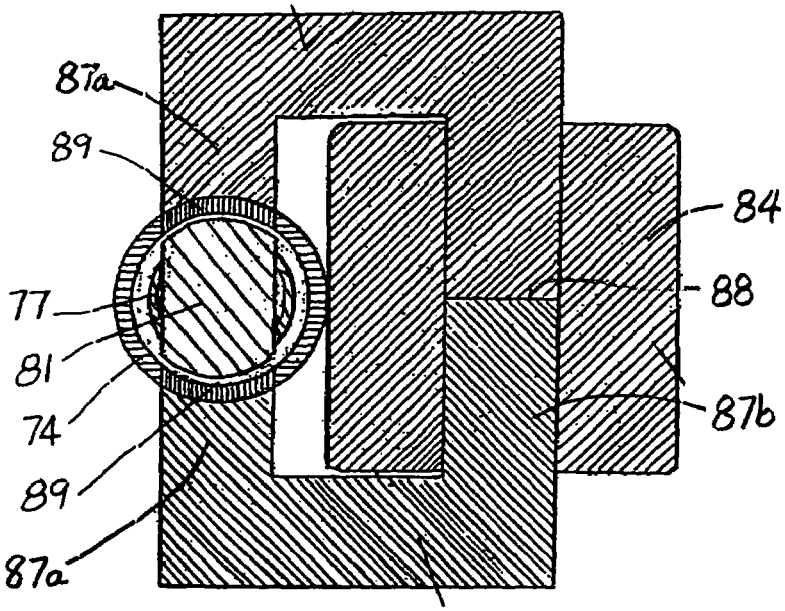

With the gas hermetically sealed within the engine, it is not necessary to replenish the gas as often as it would be if the engine were not sealed, and inlet port 18 can be closed with the plug assembly 91 of FIG. 8 rather than the valve assembly 19 of FIG. 7, if desired. Alternatively, a source of gas can be connected to the inlet port via valve assembly 19 for automatic replenishment of the gas in the chambers as in the embodiment of FIG. 1.

Plug assembly 91 includes a body or bushing 92 with a hollow interior 93 which is filled with a rubber insert 94. The inner end of the valve body is threaded into the port, and a cap 96 is threaded onto the enlarged outer end of the body to retain the insert in the plug. A gasket 97 provides a seal between the enlarged portion of the plug body and the end plate or head 16.

Operation and use of the embodiment of FIG. 5 is similar to that described above in connection with the embodiment of FIG. 1. A charge of the explosive gas is introduced into the explosion chambers through the inlet ports, and stator windings 83, 84 are energized to drive magnet 81 and the remainder of the piston assembly back and forth within the cylinder. As each of the pistons approaches its top dead center position, the gas in the explosion chamber is compressed, then ionized and ignited so that it explodes and drives the piston assembly back toward the other end of the cylinder.

As the magnet carried by the piston assembly moves back and forth within the gap in the core structure, the alternating flux it produces is coupled to coils 83, 84 to produce the output current in the generator windings.

The invention has a number of important features and advantages. It can use explosive fuel mixtures such as air, inert gases and other non-combustible gases which can be rapidly expanded and contracted multiple times to convert kinetic energy into electrical and/or mechanical power. The engine can have one or more explosion chambers with a piston forming a movable wall for changing the volume of each.

The operating gas is preloaded into the chambers, the inlet ports are sealed, and the engine an be operated with the same gas load over long periods of time and multiple explosive expansions and contractions at various frequencies, e.g. 30–60 cycles per second or more, without adding gas to the chambers.

In one disclosed embodiment, the loss of gas due to leakage is prevented by enclosing the engine in a hermetically sealed enclosure. In another, a check valve in the inlet port allows the gas in the chambers to be automatically replenished when the pressure in the chambers drops below a predetermined level. The hermetic sealing is particularly important and desirable if the engine is operated in environments such as outer space or underseas where replenishment gases may not be readily available.

The invention permits a wide range of design flexibility and can provide compact power supplies ranging in capacity from a few kilowatts to multiple megawatts, and it can be utilized in a wide variety of applications.

It is apparent from the foregoing that a new and improved internal explosion engine and generator has been provided. While only certain presently preferred embodiments have been described in detail, as will be apparent to those familiar with the art, certain changes and modifications can be made without departing from the scope of the invention as defined by the following claims.

The invention claimed is:

1. An internal explosion engine and generator, comprising an explosion chamber, a movable member forming one wall of the chamber, a charge of air sealed inside the chamber, a one-way valve in communication with the chamber for admitting additional air to the chamber if the pressure in the chamber drops below a predetermined level, means for repeatedly igniting the air in the chamber in an explosive manner to drive the movable member from a position of minimum volume to a position of maximum volume, means for returning the movable member from the position of maximum volume to the position of minimum volume, and means coupled to the movable member for providing electrical energy in response to explosion of the air.

2. The engine and generator of claim 1 wherein the movable member is a piston.

3. The engine and generator of claim 2 wherein the means for returning the movable member to the position of minimum volume comprises a flywheel on a crankshaft connected to the piston.

4. The engine and generator of claim 3 wherein the means for providing electrical energy comprises a generator connected to the crankshaft.

5. The engine and generator of claim 1 wherein the means for returning the movable member to the position of minimum volume includes a second explosion chamber having a movable member connected to the first named member, a charge of air sealed inside the second chamber, and means for igniting the air in the second chamber in an explosive manner.

6. The engine and generator of claim 1 including a hermetically sealed housing enclosing the explosion chamber and preventing loss of the air from the chamber.

7. The engine and generator of claim 1 wherein the movable member is fabricated of a ferro-magnetic material, and the means for providing electrical energy includes a coil which is coupled magnetically to the movable member.

8. The engine and generator of claim 1 wherein the means for igniting the air includes means for applying RF energy to the chamber to ionize the air and form a plasma, and means for igniting the plasma.

9. The engine and generator of claim 8 including electrodes in the chamber for heating the ionized air.

10. An internal explosion engine and generator, comprising a cylinder, a piston movable within the cylinder to form an explosion chamber of variable volume, a charge of air sealed within the chamber, means for admitting atmospheric air to the chamber if the pressure in the chamber drops below a predetermined level, means for periodically, explosively igniting the air in the chamber to drive the piston between positions of minimum and maximum volume, a crankshaft driven by the piston, and a generator connected to the crankshaft for providing electrical energy in response to movement of the piston.

11. The engine and generator of claim 10 including a flywheel on the crankshaft.

12. The engine and generator of claim 10 wherein the means for igniting the air includes means for applying RF energy to the chamber to ionize the air and form a plasma, and means for igniting the plasma.

13. The engine and generator of claim 12 including a magnetically actuated switch responsive to the position of the piston for delivering the spark when the piston is at or near the minimum volume position.

14. The engine and generator of claim 10 wherein the means for admitting atmospheric air to the chamber includes a check valve.

15. The engine and generator of claim 10 wherein the piston is fabricated of ferro-magnetic material and is coupled magnetically with a coil disposed outside cylinder.

16. The engine and generator of claim 10 including means for energizing the generator as a motor for moving the piston to start the engine.

17. An internal explosion engine and generator, comprising a cylinder, a pair of pistons connected together for movement in concert within the cylinder to form a pair of explosion chambers of variable volume, a charge of non-combustible gas sealed within each of the chambers, check valves for replenishing the gas in the chambers by admitting additional gas into the chambers when pressure in the chambers drops below a predetermined level, means for alternately igniting the non-combustible gas in the two chambers in an explosive manner to drive the pistons between positions of minimum end maximum chamber volume, a magnet coupled to the pistons for movement with the pistons, and a coil positioned outside the cylinder near the magnet for producing electrical energy in response to movement of the pistons.

18. The engine and generator of claim 17 wherein the non-combustible gas is selected from the group consisting of air, inert gas, end combinations thereof.

19. The engine and generator of claim 17 wherein the means for igniting the gas in each of the chambers includes means for applying RF energy to the chamber to ionize the gas and form a plasma, and means for igniting the plasma.

20. The engine and generator of claim 19 including switches responsive to the positions of the pistons for igniting the plasma when the pistons are at or near the minimum volume positions.

21. The engine and generator of claim 19 including electrodes in the chambers for heating the ionized gas.

* * * * *